US011527828B1

(12) United States Patent
Lim et al.

(10) Patent No.: US 11,527,828 B1
(45) Date of Patent: Dec. 13, 2022

(54) ARRAY ANTENNA WITH SHORTING PIN

(71) Applicants: Hongik University Industry-Academia Cooperation Foundation, Seoul (KR); Kookmin University Industry Academy Cooperation Foundation, Seoul (KR)

(72) Inventors: Tae Heung Lim, Seoul (KR); Byung-Jun Jang, Seoul (KR); Hosung Choo, Seoul (KR)

(73) Assignees: Hongik University Industry-Academia Cooperation Foundation, Seoul (KR); Kookmin University Industry Academy Cooperation Foundation, Seoul (KR)

( * ) Notice: Subject to any disclaimer, the term of this patent is extended or adjusted under 35 U.S.C. 154(b) by 0 days.

(21) Appl. No.: 17/386,903

(22) Filed: Jul. 28, 2021

(30) Foreign Application Priority Data

Jun. 1, 2021 (KR) ..... 10-2021-0070885

(51) Int. Cl.
*H01Q 9/04* (2006.01)
*H01Q 1/50* (2006.01)
*H01Q 21/06* (2006.01)

(52) U.S. Cl.
CPC ..... *H01Q 9/0421* (2013.01); *H01Q 1/50* (2013.01); *H01Q 21/065* (2013.01)

(58) Field of Classification Search
CPC ..... H01Q 9/0421; H01Q 1/50; H01Q 21/065
See application file for complete search history.

(56) References Cited

U.S. PATENT DOCUMENTS

| | | | | |
|---|---|---|---|---|
| 7,609,221 | B2 | 10/2009 | Chung et al. | |
| 10,581,169 | B2 | 3/2020 | Kim et al. | |
| 10,892,554 | B2 * | 1/2021 | Yamada | H01Q 21/065 |
| 2013/0169491 | A1 | 7/2013 | Montgomery et al. | |

(Continued)

FOREIGN PATENT DOCUMENTS

| | | | | |
|---|---|---|---|---|
| CN | 110854529 A | * | 2/2020 | H01Q 1/38 |
| CN | 110994199 A | * | 4/2020 | |

(Continued)

OTHER PUBLICATIONS

Korean Notice of Patent Grant dated Jun. 27, 2022, issued in Korean Application No. 10-2021-0070885.

*Primary Examiner* — Dimary S Lopez Cruz
*Assistant Examiner* — Michael M Bouizza
(74) *Attorney, Agent, or Firm* — Jefferson IP Law, LLP

(57) ABSTRACT

The disclosure relates to an array antenna, and specifically, relates to an array antenna which improves performance by using a shorting pin. The array antenna includes a first antenna, a second antenna, the first antenna and the second antenna sharing a ground, and a substrate disposed on an upper portion of the ground, and the second antenna is disposed in contact with an upper portion of the substrate, the first antenna is disposed by penetrating through centers of the substrate and the second antenna, the array antenna includes a plurality of feeding pins disposed by penetrating through the second antenna, the substrate, and the ground, and the array antenna includes a plurality of shorting pins penetrating through the second antenna, the substrate, and the ground to be symmetric with the plurality of feeding pins.

17 Claims, 10 Drawing Sheets

(56) References Cited

U.S. PATENT DOCUMENTS

| | | | | |
|---|---|---|---|---|
| 2020/0052405 | A1* | 2/2020 | Park | H01Q 21/065 |
| 2021/0098891 | A1* | 4/2021 | Haviv | H01Q 21/065 |
| 2021/0288409 | A1* | 9/2021 | Delaveaud | H01Q 9/0421 |
| 2022/0311142 | A1* | 9/2022 | Hwang | H01Q 9/045 |

FOREIGN PATENT DOCUMENTS

| | | | | |
|---|---|---|---|---|
| JP | 2006109372 | A | * | 4/2006 |
| KR | 10-2006-0117325 | A | | 11/2006 |
| KR | 10-2011-0005917 | A | | 1/2011 |
| KR | 10-2011-0104939 | A | | 9/2011 |
| KR | 10-1891562 | B1 | | 8/2018 |
| KR | 10-2019-0022074 | A | | 3/2019 |
| KR | 10-2019-0087882 | A | | 7/2019 |
| KR | 10-2080305 | B1 | | 2/2020 |

* cited by examiner

| Parameters | Values |
|---|---|
| $l_1$ (Shorting pin length) | 9.5 mm ~ 10.5 mm |
| Shorting pin & monopole material | Brass (conductivity = $2.74 \times 10^7$) |
| Shorting pin radius | 0.1 mm ~ 1 mm |
| $l_2$ (Monopole length) | 41.5 mm ~ 42.5 mm |
| Monopole radius | 0.5 mm ~ 2 mm |
| $r_1$ (Substrate center hole radius) | 1.1 mm ~ 4 mm |
| $r_2$ (Substrate pin hole radius) | 0.2 mm ~ 1.2 mm |
| $r_3$ (Patch hole radius) | 4.5 mm ~ 5.5 mm |
| $r_4$ (Patch outer radius) | 13.5 mm ~ 14.5 mm |
| Substrate material | Ceramic (er = 20, loss tangent 0.0019) |
| g | > 80 mm |

FIG.3

ARRAY ANTENNA WITH SHORTING PIN

CROSS-REFERENCE TO RELATED APPLICATION(S)

This application is based on and claims priority under 35 U.S.C. § 119(a) of a Korean patent application number 10-2021-0070885, filed on Jun. 1, 2021, in the Korean Intellectual Property Office, the disclosure of which is incorporated by reference herein in its entirety.

BACKGROUND

1. Field

The disclosure relates to an array antenna. More particularly, the disclosure relates to an array antenna which is improved by using a shorting pin.

2. Description of Related Art

Global positioning systems (GPS) are applied to various private and military industries, such as aviation, navigation, mobiles, etc., to provide information regarding positions of objects in real time. Recently, techniques for miniaturizing an array antenna and for optimizing an array formation in order to mount a GPS in a small space are being actively researched.

The above information is presented as background information only to assist with an understanding of the disclosure. No determination has been made, and no assertion is made, as to whether any of the above might be applicable as prior art with regard to the disclosure.

SUMMARY

Aspects of the disclosure are to address at least the above-mentioned problems and/or disadvantages and to provide at least the advantages described below. Accordingly, an aspect of the disclosure is to provide an array antenna, and specifically, an array antenna which improves performance by using a shorting pin.

Another aspect of the disclosure is to provide an array antenna which improves an axial ratio characteristic by using a shorting pin.

Another aspect of the disclosure is to provide an array antenna which improves a circularly polarized characteristic by using a shorting pin.

Additional aspects will be set forth in part in the description which follows and, in part, will be apparent from the description, or may be learned by practice of the presented embodiments.

In accordance with an aspect of the disclosure, an array antenna is provided. The array antenna includes a first antenna, a second antenna, the first antenna and the second antenna sharing a ground, and a substrate disposed on an upper portion of the ground, wherein the second antenna is disposed in contact with an upper portion of the substrate, wherein the first antenna is disposed by penetrating through centers of the substrate and the second antenna, wherein the array antenna includes a plurality of feeding pins disposed by penetrating through the second antenna, the substrate, and the ground, wherein the array antenna includes a plurality of shorting pins penetrating through the second antenna, the substrate, and the ground to be symmetric with the plurality of feeding pins.

Other aspects, advantages, and salient features of the disclosure will become apparent to those skilled in the art from the following detailed description, which, taken in conjunction with the annexed drawings, discloses various embodiments of the disclosure.

BRIEF DESCRIPTION OF THE DRAWINGS

The above and other aspects, features, and advantages of certain embodiments of the disclosure will be more apparent from the following description taken in conjunction with the accompanying drawings, in which:

FIG. 3 is a view illustrating a table regarding various design specifications of an array antenna according to an embodiment of the disclosure;

Throughout the drawings, like reference numerals will be understood to refer to like parts, components, and structures.

DETAILED DESCRIPTION

The following description with reference to the accompanying drawings is provided to assist in a comprehensive understanding of various embodiments of the disclosure as defined by the claims and their equivalents. It includes various specific details to assist in that understanding but these are to be regarded as merely exemplary. Accordingly, those of ordinary skill in the art will recognize that various changes and modifications of the various embodiments described herein can be made without departing from the scope and spirit of the disclosure. In addition, descriptions of well-known functions and constructions may be omitted for clarity and conciseness.

The terms and words used in the following description and claims are not limited to the bibliographical meanings, but, are merely used by the inventor to enable a clear and consistent understanding of the disclosure. Accordingly, it should be apparent to those skilled in the art that the following description of various embodiments of the disclosure is provided for illustration purpose only and not for the purpose of limiting the disclosure as defined by the appended claims and their equivalents.

It is to be understood that the singular forms "a," "an," and "the" include plural referents unless the context clearly dictates otherwise. Thus, for example, reference to "a component surface" includes reference to one or more of such surfaces.

In various embodiments of the disclosure described below, hardware-wise approach methods will be described by way of an example. However, various embodiments of the disclosure include technology using both hardware and software, and thus do not exclude software-based approach methods.

GPS is applied to various private and military industries, such as aviation, navigation, mobiles, etc., to provide information regarding positions of objects in real time. Recently, techniques for miniaturizing an array antenna and for optimizing an array formation in order to mount a GPS in a small space are being actively researched.

However, these techniques can derive a high gain characteristic and a uniform radiation pattern, but, if a ground shape is asymmetrical or there is an external structure, there may be a problem that an axial ratio characteristic and a gain characteristic of a GPS antenna are noticeably reduced.

To solve this problem, the disclosure relates to an array antenna, and specifically, describes technology of an array antenna which is provided with a shorting pin, and improves antenna performance while minimizing an array gap.

Figure 1:
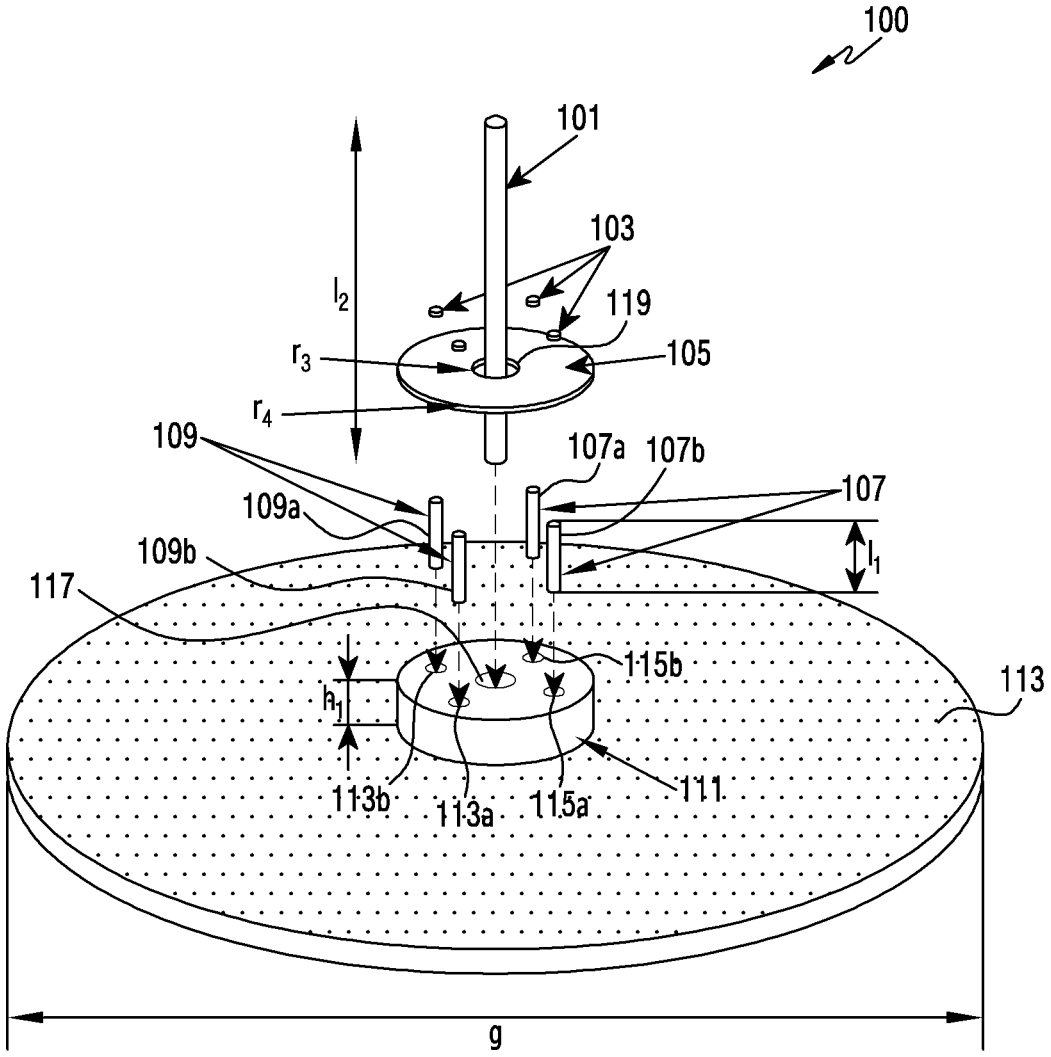
FIG. 1 is a perspective view of an array antenna according to an embodiment of the disclosure.

FIG. 1 is a perspective view of an array antenna according to an embodiment of the disclosure.

Referring to FIG. 1, an array antenna 100 may include a first antenna 101, a soldering(s) 103, a second antenna 105, a feeding pin(s) 107, a shorting pin(s) 109, a substrate 111, and/or a ground (GND) 113.

According to an embodiment, the feeding pin(s) 107 may include a first feeding pin 107*a* and/or a second feeding pin 107*b*.

According to an embodiment, the shorting pin(s) 109 may include a first shorting pin 109*a* and/or a second shorting pin 109*b*.

According to an embodiment, the substrate 111 may be disposed on a center of the ground 113 to be concentric with the ground 113, and may be disposed in contact with an upper portion of the ground 113. According to an embodiment, the ground 113 may be a circular plate having a predetermined diameter g. The substrate 111 may also be a circular plate having a predetermined height h1 and a radius.

According to an embodiment, the substrate 111 may include a hole 117 penetrating through the center of the substrate 111 and having a predetermined radius r1.

According to an embodiment, the substrate 111 may include holes 113*a*, 113*b*, 115*a*, or 115*b* disposed an outer edge of the center of the substrate 111 and having a predetermined radius r2 to have the feeding pin(s) 107 and/or the shorting pin(s) 109 inserted thereinto. According to an embodiment, the holes 113*a*, 113*b*, 115*a*, and/or 115*b* for the feeding pin(s) 107 and/or the shorting pin(s) 109 may be disposed to be symmetric with one another with respect to the origin point, which is the center of the substrate 111.

According to an embodiment, the feeding pin(s) 107 and/or the shorting pin(s) 109 may be pins that have a predetermined height I1.

According to an embodiment, the first antenna 101 may be a monopole antenna that has a predetermined height 12.

The second antenna 105 may be a patch antenna of a circular loop shape that has an internal radius r3 and an external radius r4.

According to an embodiment, the hole 117 having the radius r1 of the substrate 111 may be disposed on the center of the ground 113.

According to an embodiment, the feeding pin(s) 107 and/or the shorting pin(s) 109 may be inserted into the holes having the radius r2, and may penetrate through the ground 113.

According to an embodiment, the shorting pin(s) 109 and/or the feeding pin(s) 107 may penetrate through the second antenna 105. That is, an internal hole having the internal radius r3 of the second antenna 105 may be disposed to penetrate through the hole 117 of the ground 113 and/or the substrate 111.

According to an embodiment, the soldering(s) 103 may be disposed on an upper end of the shorting pin(s) 109 and/or the feeding pin(s) 107 penetrating through the second antenna 105.

According to an embodiment, the first antenna 101 may be disposed to penetrate through the center of the ground 113, the hole 117 having the radius r1 of the substrate, and a hole 119 of the second antenna 105 having the internal radius r3.

According to an embodiment, the second antenna may be a monopole antenna that has a predetermined height 12.

Figure 2:
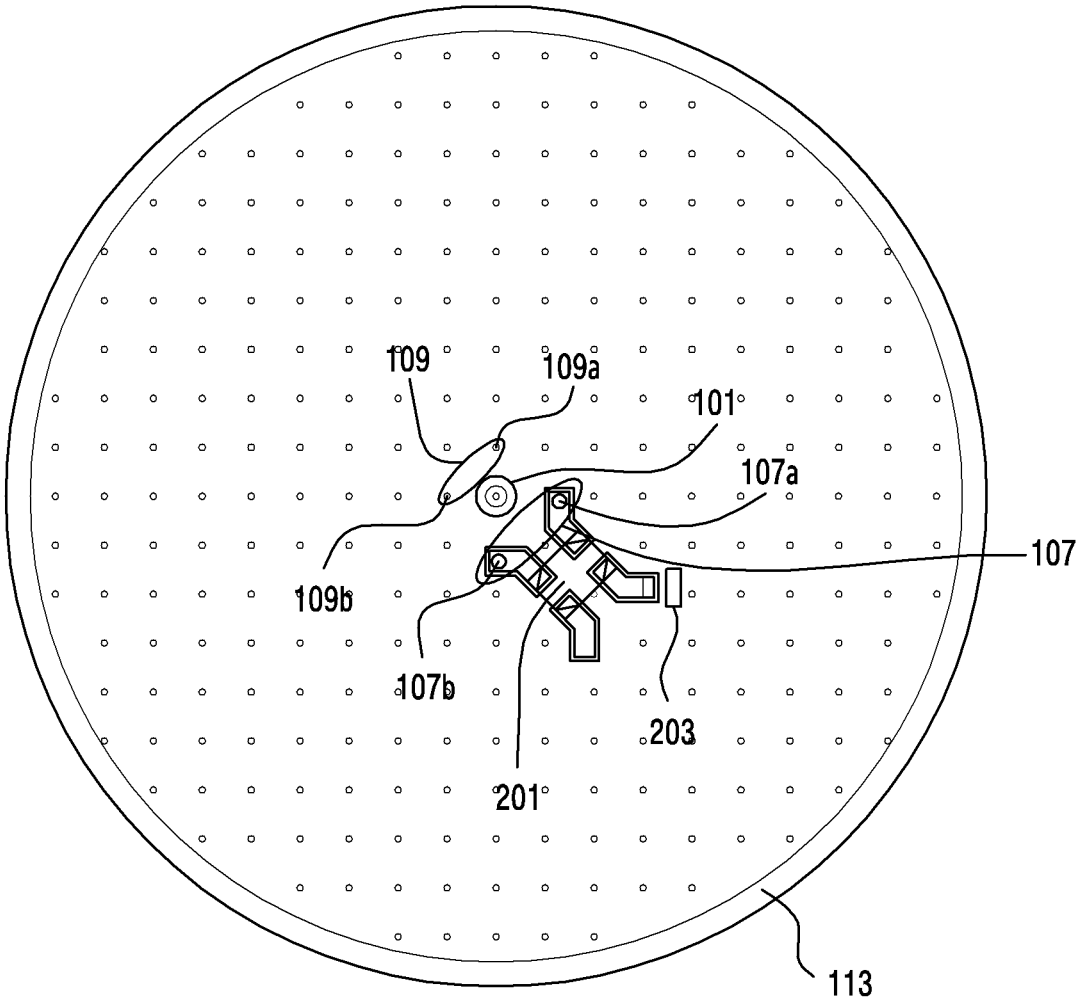
FIG. 2 is a view illustrating a bottom surface of an array antenna according to an embodiment of the disclosure.

FIG. 2 illustrates a bottom surface of an array antenna according to an embodiment of the disclosure.

Referring to FIG. 2, an array antenna may include a hybrid chip coupler 201, a first antenna port 202 and/or a second antenna port 203 which are formed on the bottom surface thereof.

According to an embodiment, the shorting pin(s) 109 may be connected by penetrating through the ground 113. The first antenna 101 may also be connected by penetrating through the ground.

According to an embodiment, the feeding pin(s) 107 may be connected by penetrating through the ground 113. The feeding pin(s) 107 may be connected to the hybrid chip coupler 210.

According to an embodiment, the hybrid chip coupler 210 may include a first hybrid chip coupler port, a second hybrid chip coupler port, a third hybrid chip coupler port, and a fourth hybrid chip coupler port.

According to an embodiment, the first hybrid chip coupler port may be connected to the first feeding pin 107*a* to have a phase difference of 0. The second hybrid chip coupler port may be connected to the second feeding pin 107*b* to have a phase difference of 180. The third hybrid chip coupler port may connect the second antenna 104 to the ground. The fourth hybrid chip coupler port may be connected to the ground 113. Through this structure, the hybrid chip coupler 201 may have a source excite the second antenna to output a difference of 0 degrees, 90 degrees, and the second antenna 105 may operate as a circular polarized (CP) antenna.

According to an embodiment, the second antenna port 203 may apply the source by using a coaxial cable.

According to an embodiment, the first antenna 101 may be connected to the ground 113 via the first antenna port 202.

FIG. 3 illustrates a table regarding various design specifications of an array antenna according to an embodiment of the disclosure. The table shown in FIG. 3 illustrates various design specifications and the disclosure is not limited thereto.

Referring to FIG. 3, a height I1 of a shorting pin(s) 109 may be higher than a height of a substrate 111. For example, the shorting pin(s) 109 may have a height from about 9.5 mm to 10.5 mm.

According to an embodiment, the shorting pin(s) may have a radius smaller than the hole 113*a*, 113*b*, 115*a*, and/or 115*b* having the predetermined radius r2 to have the shorting pin(s) 109 inserted thereinto. For example, the radius of the shorting pin(s) may be between 0.1 mm and 1 mm.

According to an embodiment, the short pin(s) 109 and the first antenna (for example, a monopole antenna) 101 may be formed with brass.

According to an embodiment, the first antenna (for example, a monopole antenna) 101 may have a height 12 between 41.55 mm and 42.5 mm, for example. The radius of the first antenna 101 may be smaller than the hole 117 penetrating through the center of the substrate 111 and having the predetermined radius r1. For example, the radius of the first antenna 101 may be about 0.5 mm-2 mm.

According to an embodiment, the hole 117 penetrating through the center of the substrate 111 and having the predetermined radius r1 may have a radius from about 1.1 mm to 4 mm to have the first antenna penetrate therethrough.

According to an embodiment, the hole 113*a*, 113*b*, 115*a*, and/or 115*b* having the predetermined radius r2 to have the shorting pin(s) 109 inserted thereinto may have a radius from about 0.2 mm to 1.2 mm to have the shorting pin(s) 109 and the feeding pin(s) inserted thereinto.

According to an embodiment, the internal radius r3 of the second antenna 105 may be larger than the radius of the first antenna or may be larger than the radius r1 of the center hole of the substrate. For example, the internal radius of the second antenna 105 may be about 4.5 mm to 5.5 mm.

According to an embodiment, the external radius r4 of the second antenna 105 may be similar to or the same as the radius of the substrate. For example, the external radius r4 of the second antenna 105 may be about 13.5 mm to 14.5 mm.

According to an embodiment, the diameter of the ground 113 may be even larger than the external radius r4 of the second antenna 105. For example, the diameter of the ground 113 may have a value greater than or equal to about 80 mm.

The array antenna 100 having the structure shown in FIGS. 1, 2, and/or 3 can solve the problem that circular polarized characteristics are degraded by the first antenna disposed at the center of the ground 113, by using the shorting pin(s) 109.

Hereinafter, improved characteristics of the array antenna 100 will be described with reference to the drawings.

Figure 4A:
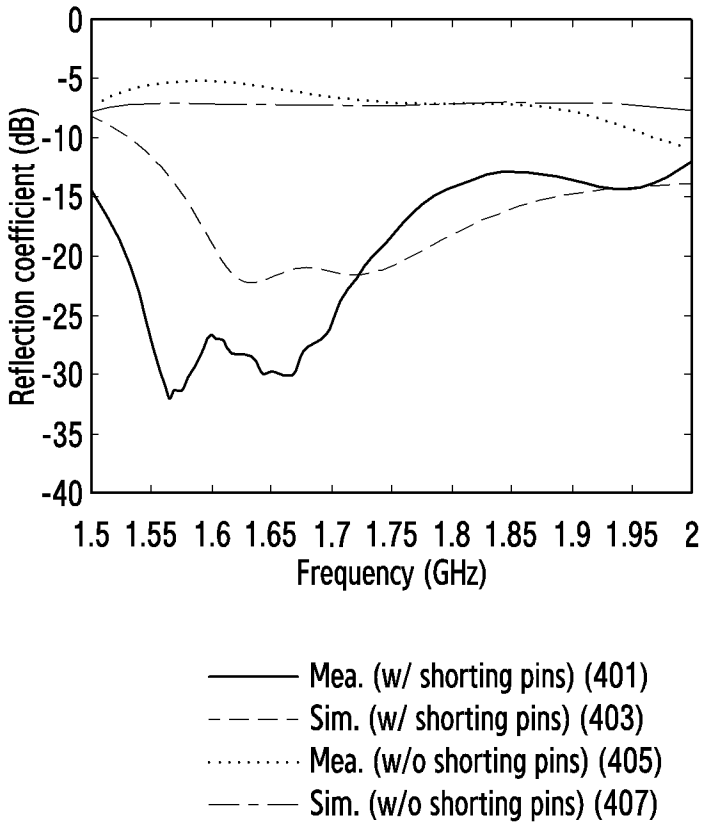
FIG. 4A is a view illustrating a graph regarding a reflection coefficient of an array antenna according to an embodiment of the disclosure.
Figure 4B:
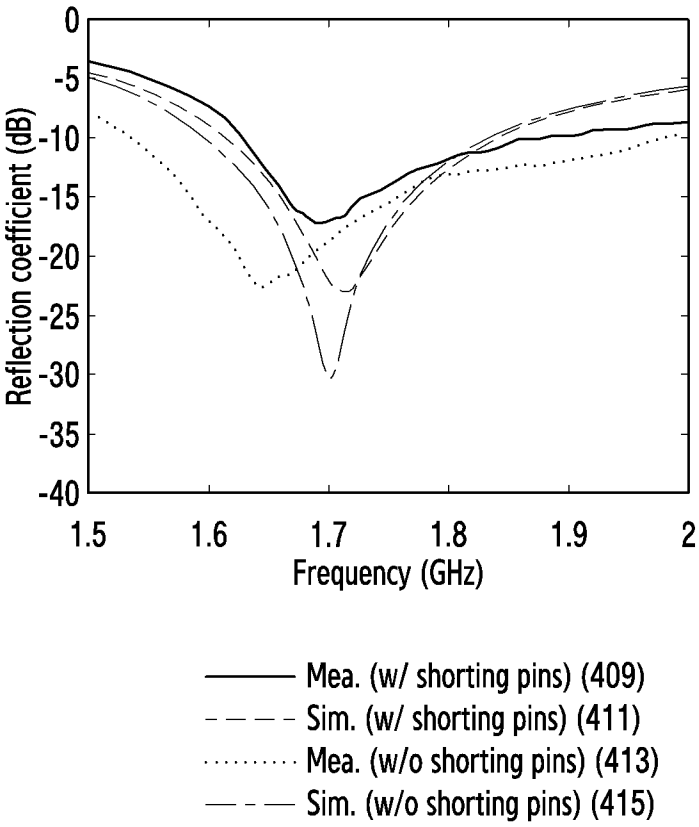
FIG. 4B is a view illustrating a graph regarding a reflection coefficient of an array antenna according to an embodiment of the disclosure.

FIG. 4A illustrates a graph regarding a reflection coefficient of an array antenna according to an embodiment of the disclosure, and FIG. 4B illustrates a graph regarding a reflection coefficient of an array antenna according to an embodiment of the disclosure.

Referring to FIGS. 4A and 4B, FIG. 4A illustrates a reflection coefficient when a second antenna 105 is a patch antenna, and FIG. 4B illustrates the reflection coefficient when a first antenna 101 is a monopole antenna.

Referring to FIG. 4A, solid line 401 indicates a measurement value of a second antenna 105 including a shorting pin(s) 109, dashed line 403 indicates a simulation value of the second antenna 105 including the shorting pin(s) 109, dotted line 405 indicates a measurement value of the second antenna 105 that does not include the shorting pin(s) 109, and alternate long and short dash line 407 indicates a simulation value of the second antenna 105 that does not include the shorting pin(s) 109.

Referring to FIG. 4B, solid line 409 indicates a measurement value of a first antenna 101 including the shorting pin(s), dashed line 411 indicates a simulation value of the first antenna 101 including the shorting pin(s), dotted line 413 indicates a measurement value of the first antenna 101 that does not include the shorting pin(s), and alternate long and short dash line 415 indicates a simulation value of the first antenna 101 that does not include the shorting pin(s).

Referring to FIGS. 4A and 4B, when the second antenna 105 is a patch antenna and includes the shorting pin(s) 109, the measured reflection coefficient is found to be −26.7 dB, and, when the second antenna 105 does not include the shorting pin(s) 109, the reflection coefficient is found to be −5.2 dB. It can be seen that, when the array antenna includes the shorting pin(s) 109, the array antenna has better performance in terms of the reflection coefficient.

When the first antenna is a monopole antenna and includes the shorting pin(s) 109, the reflection coefficient is found to be −17.1 dB, and, when the first antenna does not include the shorting pin(s) 109, the reflection coefficient is found to be −7.5 dB.

As a result, the array antenna 100 including the shorting pin(s) 109 shown in FIG. 1 and/or FIG. 2 can have more improved performance in terms of the reflection coefficient.

Figure 5A:
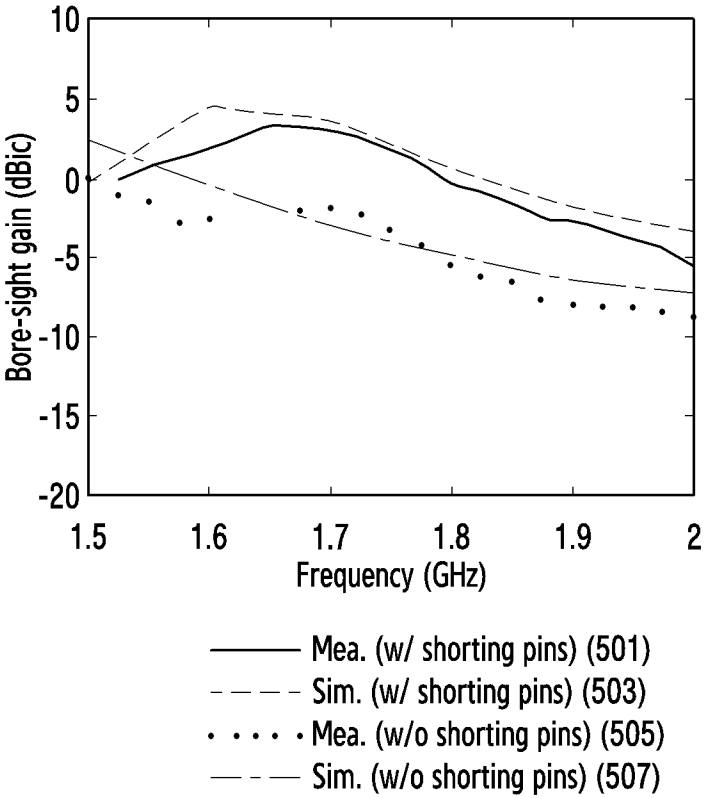
FIG. 5A is a view illustrating a graph regarding a boresight gain of an array antenna according to an embodiment of the disclosure.
Figure 5B:
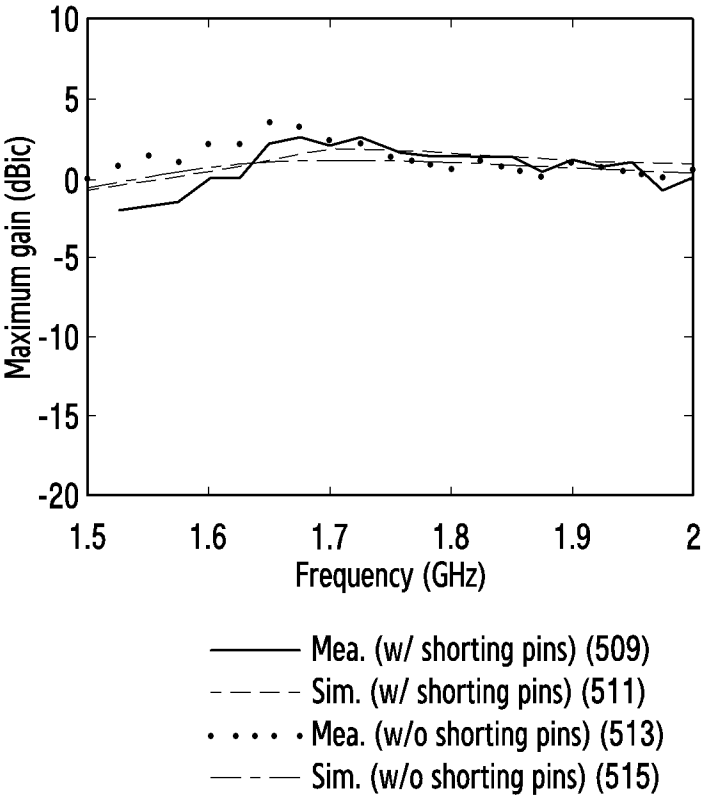
FIG. 5B is a view illustrating a graph regarding a boresight gain of an array antenna according to an embodiment of the disclosure.

FIG. 5A illustrates a graph regarding a bore-sight gain of an array antenna according to an embodiment of the disclosure, and FIG. 5B illustrates a graph regarding a bore-sight gain of an array antenna according to an embodiment of the disclosure.

Referring to FIGS. 5A and 5B, FIG. 5A illustrates a bore-sight gain (realized gain) when a second antenna 105 is a patch antenna, and FIG. 5B illustrates the bore-sight gain (realized gain) when a first antenna 101 is a monopole antenna.

Referring to FIG. 5A, solid line 501 indicates a measurement value of a second antenna 105 including a shorting pin(s) 109, dashed line 503 indicates a simulation value of the second antenna 105 including the shorting pin(s) 109, dotted line 505 indicates a measurement value of the second antenna 105 that does not include the shorting pin(s) 109, and alternate long and short dash line 507 indicates a simulation value of the second antenna 105 that does not include the shorting pin(s) 109.

Referring to FIG. 5B, solid line 509 indicates a measurement value of a first antenna 101 including a shorting pin(s) 109, dashed line 511 indicates a simulation value of the first antenna 101 including the shorting pin(s) 109, dotted line 513 indicates a measurement value of the first antenna 101 that does not include the shorting pin(s) 109, and alternate long and short dash line 515 indicates a simulation value of the first antenna 101 that does not include the shorting pin(s) 109.

Referring to FIGS. 5A and 5B, when the second antenna 105 is a patch antenna and does not include the shorting pin(s) 109, the measured bore-sight gain is found to be 1.9 dBic, and, when the second antenna 105 includes the shorting pin(s) 109, the bore-sight gain measures −2.6 dBic.

When the first antenna 101 is a monopole antenna and does not include the shorting pin(s) 109, the measured bore-sight gain is found to be 0 dBic, and, when the first antenna 101 includes the shorting pin(s) 109, the measured bore-sight gain is found to be 2.2 dBic.

That is, it can be seen that a right handed circularized polarized (RHCP) gain in the bore-sight direction that does not appear in the second antenna 105 well appears due to the shorting pin(s) 109. On the other hand, it can be seen that the bore-sight gain of the first antenna 101 is constantly maintained.

Figure 6:
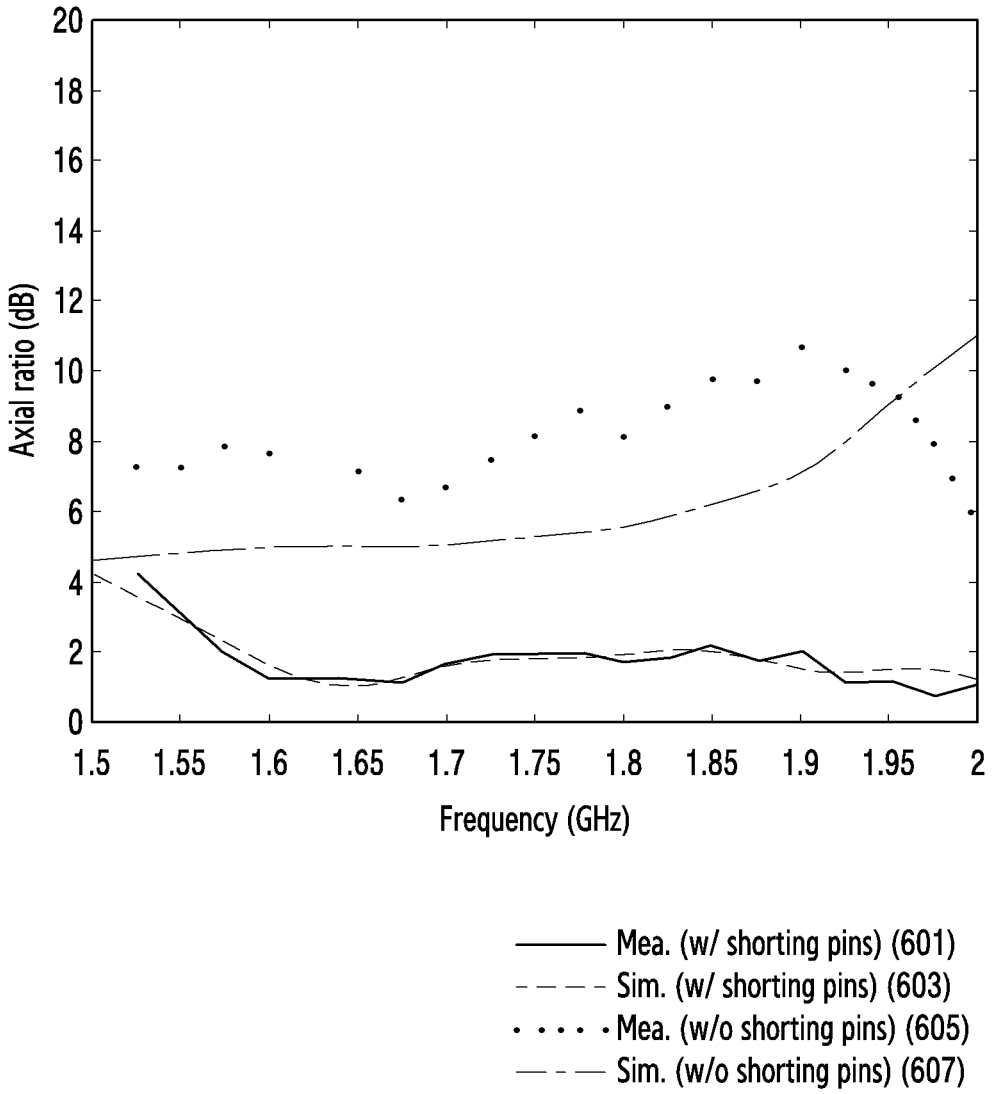
FIG. 6 is a view illustrating a graph regarding an axial ratio of a second antenna of an array antenna according to an embodiment of the disclosure.

FIG. 6 illustrates a graph regarding an axial ratio of a second antenna of an array antenna according to an embodiment of the disclosure. FIG. 6 illustrates a case in which the second antenna is a patch antenna.

Referring to FIG. 6, solid line 601 indicates a measurement value of a second antenna 105 including a shorting pin(s) 109, dashed line 603 indicates a simulation value of the second antenna 105 including the shorting pin(s) 109, dotted line 605 indicates a measurement value of the second antenna 105 that does not include the shorting pin(s) 109, and alternative long and short dash line 607 indicates a simulation value of the second antenna 105 that does not include the shorting pin(s) 109.

As can be seen from the drawings, when the shorting pin(s) 109 is not included, the axial ratio is found to be 5 dB or higher due to the first antenna (e.g., a monopole antenna) and the antenna array has an elliptical polarization characteristic. On the other hand, when the shorting pin(s) 109 is used, the axial ratio is found to be 3 dB or less and the RHCP axial ratio characteristic is not degraded, and a circular polarization is well derived.

Figure 7:
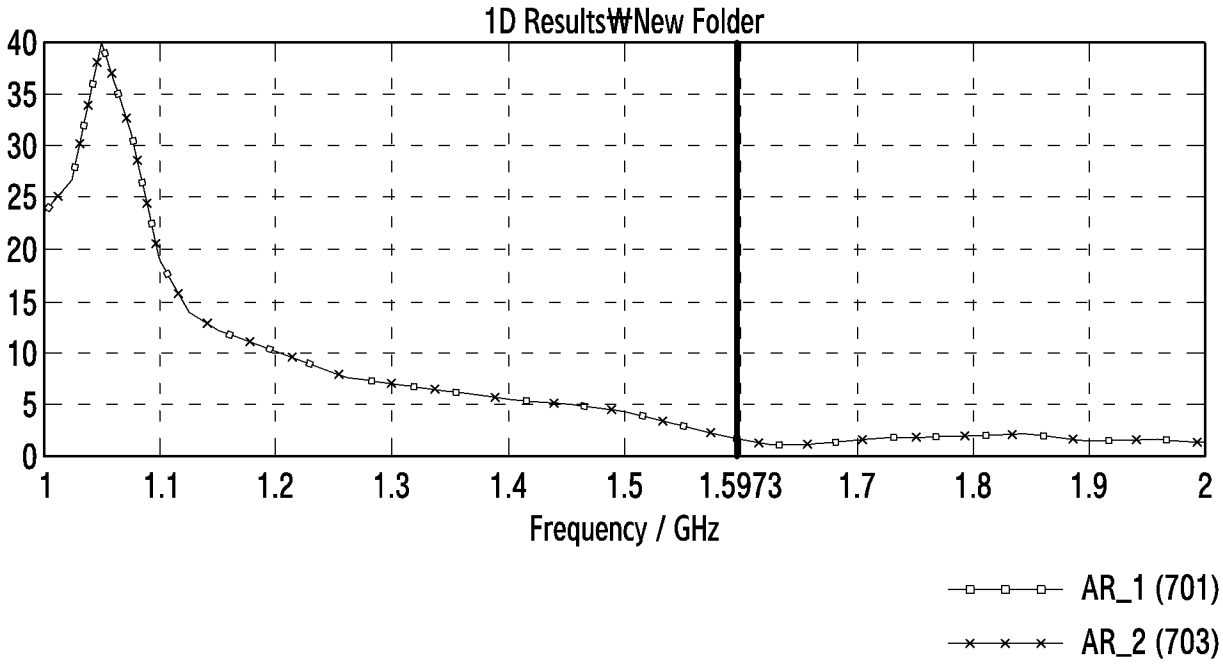
FIG. 7 is a view illustrating a graph regarding an axial ratio according to a material of a shorting pin of an array antenna according to an embodiment of the disclosure.

FIG. 7 illustrates a graph regarding an axial ratio according to a material of a shorting pin of an array antenna according to an embodiment of the disclosure.

Referring to FIG. 7, first line 701 indicates a case where the shorting pin(s) 109 is formed with copper. Second line 703 indicates a case where the shorting pin(s) 109 is formed with brass. Referring to the graph, it can be seen that the relationship between the axial ratio and the frequency is not different according to a material.

Figure 8:
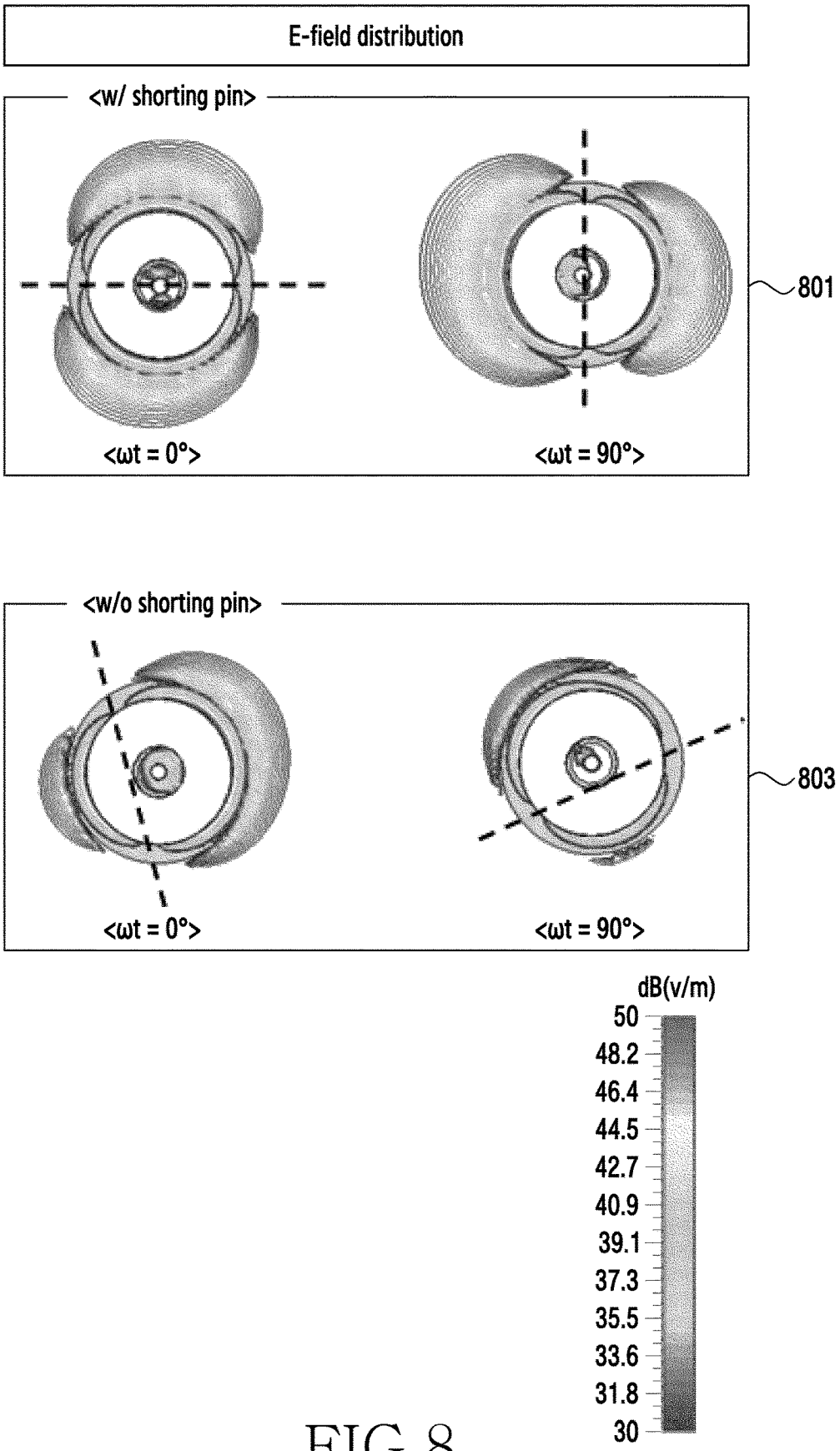
FIG. 8 is a view illustrating an electric field distribution of an array antenna according to an embodiment of the disclosure.

FIG. 8 illustrates an electric field distribution of an array antenna according to an embodiment of the disclosure.

Referring to FIG. 8, box 801 shows an electric field distribution regarding an array antenna 100 including a shorting pin(s) 109, and box 803 shows an electric field distribution regarding the array antenna 100 that does not include the shorting pin(s) 109.

Referring to the box 801, when the array antenna 100 includes the shorting pin(s) 109, a symmetric E-field distribution is formed if $\omega t=0°$ or $\omega t=90°$.

Referring to the box 803, when the array antenna 100 does not include the shorting pin(s) 109, an asymmetric E-field distribution is formed if $\omega t=0°$ or $\omega t=90°$.

Figure 9:
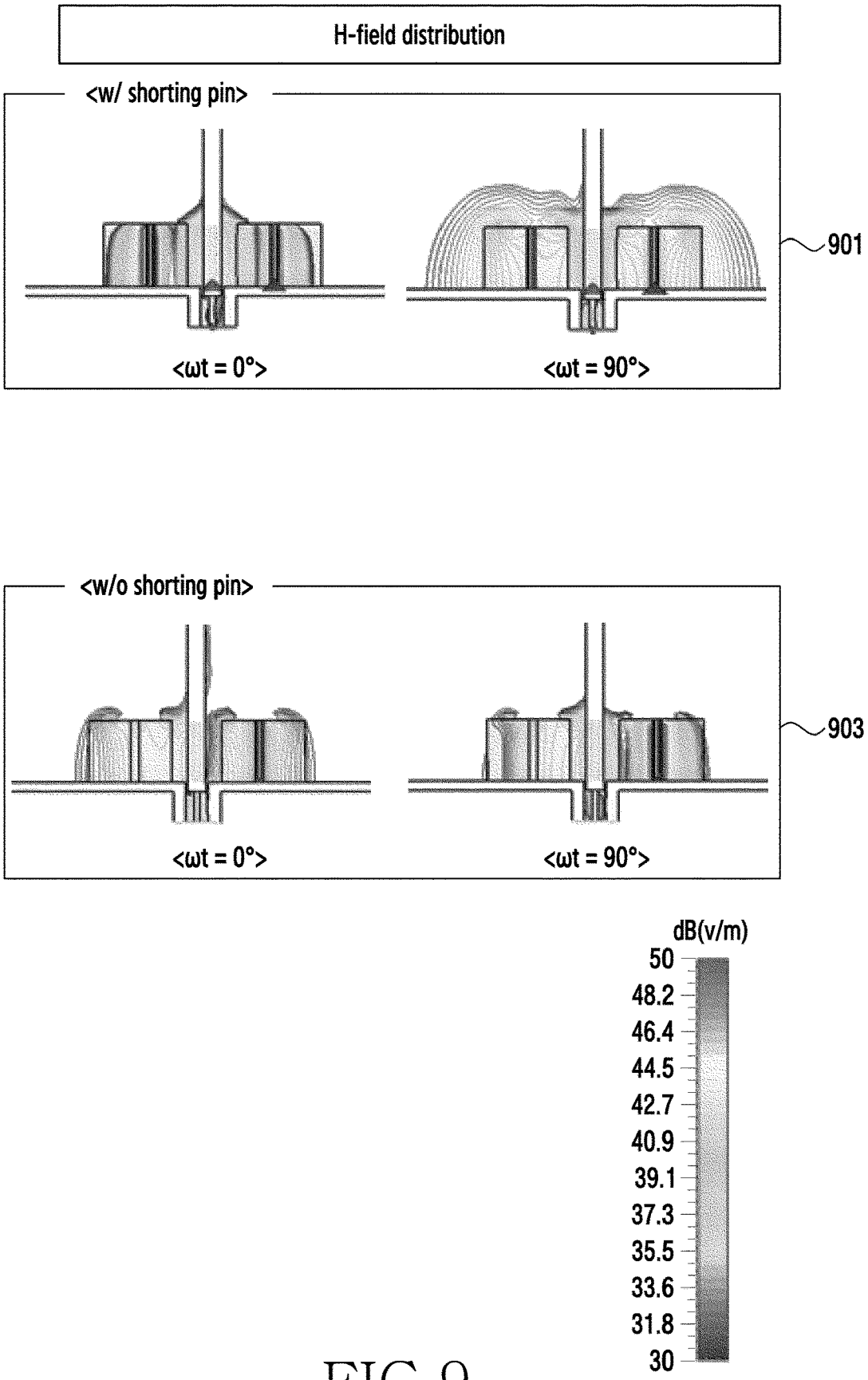
FIG. 9 is a view illustrating a magnetic field distribution of an array antenna according to an embodiment of the disclosure.

FIG. 9 illustrates a magnetic field distribution of an array antenna according to an embodiment of the disclosure.

Referring to FIG. 9, box 901 shows a magnetic field distribution regarding an array antenna 100 that include a shorting pin(s) 109, and box 903 shows a magnetic field distribution regarding the array antenna 100 that does not include the shorting pin(s) 109.

Referring to the box 901, when the array antenna 100 includes the shorting pin(s) 109, a symmetric H-field distribution is formed if $\omega t=0°$ or $\omega t=90°$.

Referring to the box 903, when the array antenna 100 does not include the shorting pin(s) 109, an asymmetric H-field distribution is formed if $\omega t=0°$ or $\omega t=90°$.

Figure 10:
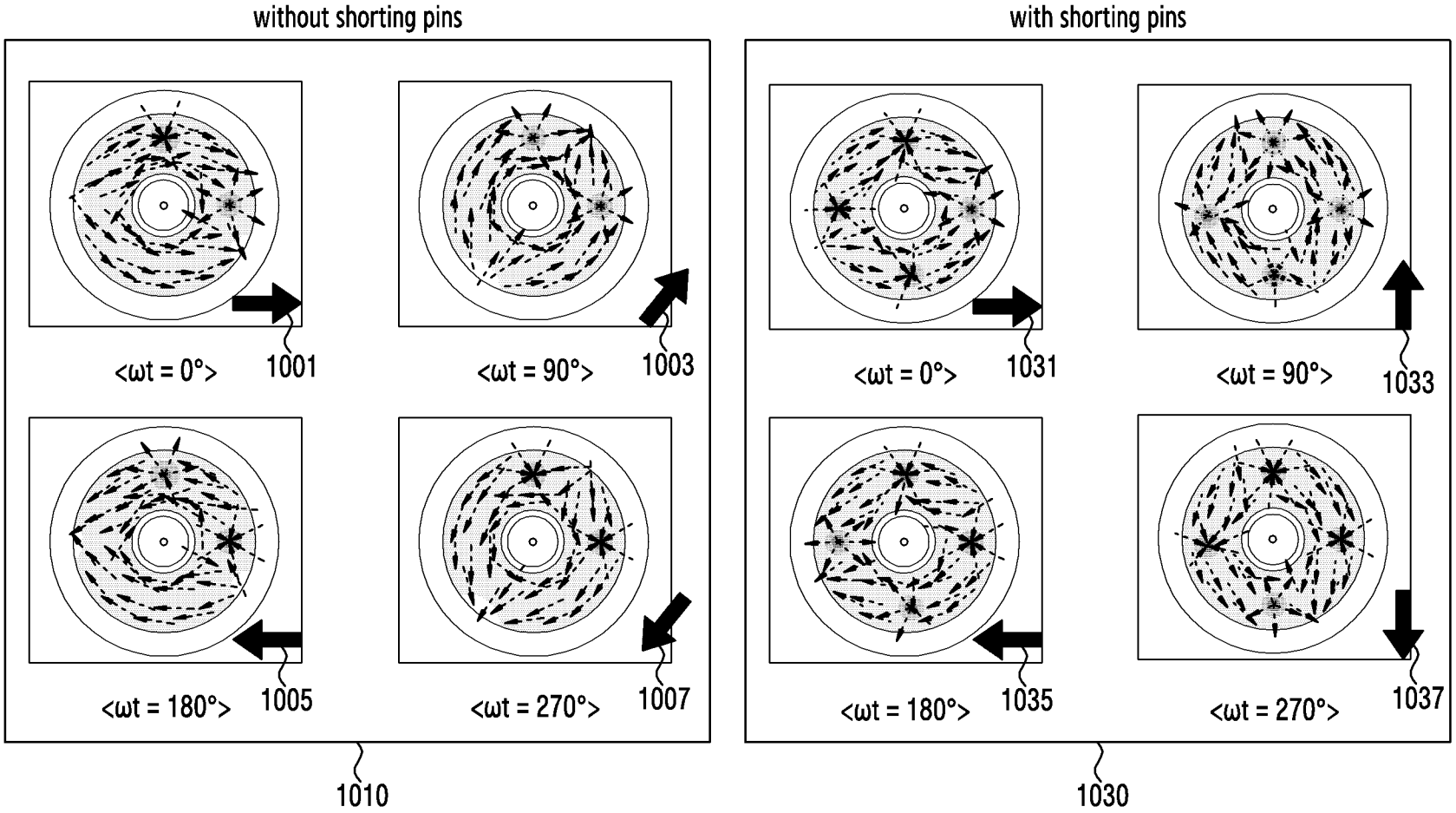
FIG. 10 is a view illustrating a current of a second antenna of an array antenna according to an embodiment of the disclosure.

FIG. 10 illustrates a current regarding a second antenna of an array antenna according to an embodiment of the disclosure.

Referring to FIG. 10, box 1010 illustrates a current flow of a second antenna when an array antenna does not include a shorting pin(s) 109. Box 1030 illustrates a current flow of the second antenna when the array antenna includes the shorting pin(s) 109. In the box 1010 and/or the box 1030, a generated inrush current is expressed by a dashed line. Arrow 1001, 1003, 1005, 1007, 1031, 1033, 1035, and/or 1037 indicates a direction of a net current formed in response to each $\omega t$.

In the box 1010 and/or the box 1030, it can be seen that, if $\omega t=0°$ (degrees) and/or $\omega t=180°$ (degrees), the arrow 1001, 1005, 1031, and/or 1035 expressing the net current indicates 0°, 180°.

It can be seen from the box 1010 that, if $\omega t=90°$, the arrow 1003 expressing the net current indicates 45 degrees, whereas it can be seen from the box 1030 that, if $\omega t=90°$, the arrow 1033 expressing the net current indicates 90 degrees. That is, it can be seen that, when the shorting pin(s) 109 is included, performance of the array antenna is improved.

It can be seen from the box 1010 that, if $\omega t=270°$, the arrow 1007 expressing the net current indicates 225 degrees, whereas it can be seen from the box 1030 that, if $\omega t=270°$, the arrow 1037 expressing the net current indicates 275 degrees. That is, it can be seen that, when the shorting pin(s) 109 is included, performance of the array antenna is improved.

According to an embodiment, an array antenna may include a first antenna, a second antenna, the first antenna and the second antenna sharing a ground, and a substrate disposed on an upper portion of the ground, and the second antenna may be disposed in contact with an upper portion of the substrate, the first antenna may be disposed by penetrating through centers of the substrate and the second antenna, the array antenna may include a plurality of feeding pins disposed by penetrating through the second antenna, the substrate, and the ground, and the array antenna may include a plurality of shorting pins penetrating through the second antenna, the substrate, and the ground to be symmetric with the plurality of feeding pins.

According to an embodiment, the first antenna may be a monopole antenna.

According to an embodiment, the second antenna may be a patch antenna of a circular loop shape.

According to an embodiment, the array antenna may include solderings disposed on upper portions of the plurality of feeding pins and the plurality of shorting pins to connect the second antenna.

According to an embodiment, a first antenna port which penetrates through the substrate and is connected with the first antenna, and a second antenna port which penetrates through the substrate and is connected with the second antenna may be disposed on lower portions of the ground.

According to an embodiment, the first antenna port and the second antenna port may penetrate through the ground, may be spaced apart from each other, and may protrude from a bottom surface of the ground.

According to an embodiment, the first antenna may be extended from the center of the second antenna perpendicularly to a plane including the second antenna.

According to an embodiment, the plurality of feeding pins may include a first feeding pin and a second feeding pin, the plurality of shorting pins may include a first shorting pin and a second shorting pin, the first shorting pin may be symmetric with the first feeding pin with respect to a y-axis, and may be symmetric with the second feeding pin with respect to an origin point, and the second shorting pin may be symmetric with the first feeding pin with respect to the origin point, and may be symmetric with the second feeding pin with respect to the y-axis.

According to an embodiment, a hybrid chip coupler may be connected to a lower portion of the ground.

According to an embodiment, the hybrid chip coupler may be connected to the second antenna port and the plurality of feeding pins.

According to an embodiment, the substrate may be a substrate of a circular loop shape.

According to an embodiment, the ground may have a circular loop shape.

According to an embodiment, the first feeding pin may be connected to the hybrid chip coupler to have a phase difference of 0, and the second feeding pin may be to the hybrid chip coupler to have a phase difference of 180.

According to an embodiment, the second antenna port may be connected to the ground by using a coaxial cable.

The array antenna according to various embodiments of the disclosure can improve an axial ratio characteristic and a circularly polarized (CP) characteristic by using a shorting pin.

The effect achieved by the disclosure is not limited to those mentioned above, and other effects that are not mentioned above may be clearly understood to those skilled in the art based on the description provided above.

The terms indicating components of the apparatus used in the following description are exemplified for convenience of explanation. Accordingly, the disclosure is not limited by the terms described below and other terms having the same technical meanings may be used.

In addition, in the disclosure, the expression "exceeding" or "being less than" may be used to determine whether a specific condition is satisfied, fulfilled, but these are just for expressing one example and do not exclude the expression "being greater than or equal to" or "being less than or equal to". The condition described by "being greater than or equal to" may be substituted with "exceeding", the condition described by "being less than or equal to" may be substituted with "being less than", and the condition described by "being greater than or equal to and less than" may be substituted with "exceeding and less than or equal to".

The method according to an embodiment may be implemented in the form of a program command that can be performed through various computer means, and may be recorded on a computer-readable medium. The computer-readable medium may include program commands, data files, data structures either alone or in combination. The program commands recorded on the medium may be those that are especially designed and configured for embodiments, or may be those that are publicly known and available to those skilled in the computer software. Examples of the computer-readable medium include magnetic recording media such as hard disks, floppy disks and magnetic tapes, optical media such as compact disc read only memories (CD-ROMs) and digital versatile discs (DVDs), magneto-optical media such as floptical disks, and hardware devices such as ROMs, random access memories (RAMs) and flash memories that are especially configured to store and execute program commands. Examples of the program commands include machine language codes created by a compiler, and high-level language codes that can be executed by a computer by using an interpreter. The above hardware device may be configured to operate as one or more software modules for performing operations of various embodiments, and vice versa.

While the disclosure has been described with limited embodiments and the drawings, it will be understood by those skilled in the art that various changes and modifications can be made from the above descriptions. For example, even if the techniques described above are performed in a different order from the method described above, and/or components such as systems, structures, devices, circuitries described above are coupled or combined in other forms than described above, or are substituted with other components or equivalents, appropriate results can be achieved.

While the disclosure has been shown and described with reference to various embodiments thereof, it will be understood by those skilled in the art that various changes in form and details may be made therein without departing from the spirit and scope of the disclosure as defined by the appended claims and their equivalents.

What is claimed is:

1. An array antenna comprising:

a first antenna;

a second antenna, the first antenna and the second antenna sharing a ground;

a substrate disposed on an upper portion of the ground;

a plurality of feeding pins penetrating through the second antenna, the substrate, and the ground; and a plurality of shorting pins penetrating through the second antenna, the substrate, and the ground, the plurality of shorting pins being symmetric with the plurality of feeding pins, wherein the second antenna contacts an upper portion of the substrate, and wherein the first antenna penetrates through a center of the substrate and through a center of the second antenna.

2. The array antenna of claim 1, wherein the first antenna comprises a monopole antenna.

3. The array antenna of claim 2, wherein the second antenna comprises a patch antenna of a circular loop shape.

4. The array antenna of claim 3, wherein the first antenna extends from the center of the second antenna in a direction perpendicular to a plane comprising the second antenna.

5. The array antenna of claim 1, wherein the array antenna further comprises solderings disposed on upper portions of the plurality of feeding pins and the plurality of shorting pins to connect the second antenna.

6. The array antenna of claim 1, wherein a first antenna port penetrates through the substrate and is connected with the first antenna, wherein a second antenna port penetrates through the substrate and is connected with the second antenna, and wherein the first antenna port and the second antenna port are disposed on lower portions of the ground.

7. The array antenna of claim 6, wherein the first antenna port and the second antenna port penetrate through the ground, are spaced apart from each other, and protrude from a bottom surface of the ground.

8. The array antenna of claim 7, wherein a coaxial cable connects the second antenna port to the ground.

9. The array antenna of claim 6, wherein a hybrid chip coupler is connected to a lower portion of the ground.

10. The array antenna of claim 9, wherein the hybrid chip coupler is connected to the second antenna port and the plurality of feeding pins.

11. The array antenna of claim 1, wherein the plurality of feeding pins comprise a first feeding pin and a second feeding pin, wherein the plurality of shorting pins comprise a first shorting pin and a second shorting pin, wherein the first shorting pin is symmetric with the first feeding pin with respect to a y-axis, wherein the first shorting pin is symmetric with the second feeding pin with respect to an origin point, wherein the second shorting pin is symmetric with the first feeding pin with respect to the origin point, and wherein the second shorting pin is symmetric with the second feeding pin with respect to the y-axis.

12. The array antenna of claim 11, wherein the first feeding pin is connected to a hybrid chip coupler to have a phase difference of 0, and wherein the second feeding pin is connected to the hybrid chip coupler to have a phase difference of 180.

13. The array antenna of claim 1, wherein the substrate comprises a circular loop shape.

14. The array antenna of claim 1, wherein the ground comprises a circular loop shape.

15. The array antenna of claim 1, wherein the substrate is disposed on a center of the ground and arranged concentric with the ground.

16. The array antenna of claim 1, wherein a diameter of the ground is greater than an external radius of the second antenna.

17. The array antenna of claim 1, wherein a height the plurality of shorting pins is greater than a height of the substrate.

* * * * *